US009238944B2

(12) United States Patent
Tian et al.

(10) Patent No.: US 9,238,944 B2
(45) Date of Patent: Jan. 19, 2016

(54) TRI-CONE BIT FOR HIGH RPM DRILLING APPLICATIONS

(75) Inventors: Hongping Tian, Hubei (CN); Zengyuan Shao, Hubei (CN); Xiaobing Fan, Hubei (CN)

(73) Assignee: Kingdream Public Ltd. Co., Wuhan (CN)

( * ) Notice: Subject to any disclaimer, the term of this patent is extended or adjusted under 35 U.S.C. 154(b) by 219 days.

(21) Appl. No.: 13/044,083

(22) Filed: Mar. 9, 2011

(65) Prior Publication Data

US 2011/0220423 A1 Sep. 15, 2011

(30) Foreign Application Priority Data

Mar. 9, 2010 (CN) ..... 2010 1 0123043
Sep. 15, 2010 (CN) ..... 2010 1 0291410

(51) Int. Cl.
*E21B 10/22* (2006.01)
*E21B 10/25* (2006.01)

(52) U.S. Cl.
CPC ..... *E21B 10/22* (2013.01); *E21B 10/25* (2013.01)

(58) Field of Classification Search
CPC ..... E21B 10/22; E21B 10/25; E21B 10/50; E21B 10/46; E21B 4/003; E21B 10/06; E21B 10/23; F16C 19/40; F16C 2352/00; F16C 33/3713; F16C 33/3706; F16C 21/00; F16C 19/49; F16C 33/4688
USPC ..... 175/371, 372, 374; 384/92–96, 126, 384/551–555
See application file for complete search history.

(56) References Cited

U.S. PATENT DOCUMENTS 3,208,806 A * 9/1965 Grolmann et al. ..... 384/520
3,356,427 A * 12/1967 Van Wyk ..... 384/463

(Continued)

FOREIGN PATENT DOCUMENTS

CN 2475816 2/2002 ..... E21B 10/02
GB 2278865 12/1994 ..... E21B 10/22

OTHER PUBLICATIONS

Tian et al., "Research on Compound Bearing of Sliding and Rolling", No. 1, 2003, pp. 60-63.

(Continued)

*Primary Examiner* — Blake Michener
*Assistant Examiner* — Wei Wang
(74) *Attorney, Agent, or Firm* — Fish & Richardson P.C.

(57) ABSTRACT

This invention relates to a tri-cone bit for high RPM drilling applications, which comprises three head sections and three cones. Cutting elements are arranged on each cone. Upper parts of the three head sections are joined together to form a bit body, on which nozzle sockets are provided, and nozzles are installed in bores of the nozzle sockets. A bearing between the cones and the head sections is a composite roller-journal bearing which is formed by rollers and arc-shaped slides arranged in an alternating way, and a seal means for the bearing is of metal face type. The composite roller-journal bearing of the invention can withstand high RPM and high load, and also has a higher resistance to impact, thereby ensuring longer working life of the bearing under high RPM and medium-high WOB. The six-point gage protection structure enhances stability of the bit and reduces cutting element breakage caused by bit vibration. The above tri-cone bit is suitable for high RPM and medium-high WOB drilling applications and features high drilling efficiency and long service life.

11 Claims, 4 Drawing Sheets

(56) References Cited

U.S. PATENT DOCUMENTS

| | | | | | |
|---|---|---|---|---|---|
| 3,966,274 | A | | 6/1976 | Penny | 308/8.2 |
| 4,167,219 | A | * | 9/1979 | McQueen | 384/93 |
| 4,514,097 | A | * | 4/1985 | Daly | 384/93 |
| 4,516,641 | A | * | 5/1985 | Burr | 175/228 |
| 4,923,020 | A | * | 5/1990 | Kelly et al. | 175/372 |
| 5,360,076 | A | * | 11/1994 | Kelly et al. | 175/371 |
| 6,109,790 | A | * | 8/2000 | von Gynz-Rekowski et al. | 384/97 |
| 7,559,381 | B2 | * | 7/2009 | Lin | 175/372 |
| 2008/0060852 | A1 | * | 3/2008 | Chandila et al. | E21B 10/16 175/374 |
| 2010/0032215 | A1 | * | 2/2010 | Shao et al. | 175/336 |

OTHER PUBLICATIONS

Canadian Office Action; CA 2,733,618; Jul. 7, 2015; 4 pages.

* cited by examiner

TRI-CONE BIT FOR HIGH RPM DRILLING APPLICATIONS

CROSS REFERENCE TO RELATED APPLICATIONS

Pursuant to 35 USC §119, this application claims the benefit of Chinese Patent Application No. 201010123043.0 filed Mar. 9, 2010 and Chinese Patent Application No. 201010291410.8 filed Sep. 15, 2010. The above applications are incorporated by reference in their entirety.

BACKGROUND OF THE INVENTION

1. Field of the Invention

The disclosure herein relates generally to a tri-cone bit. More particularly, the disclosure relates to a tri-cone bit for high RPM drilling applications in subterranean exploration and petroleum drilling industries.

2. Description of Related Art

Current tri-cone bit typically comprises a bit body. The bit body has three head sections, with a cantilevered bearing shaft at a lower end of each head section, and three cones each of which is mounted on a corresponding bearing shaft. A bearing couple is formed by the bearing shaft and inner bore of the cone. The bearing couple transfers WOB and torque to the cone. At present, journal bearing and roller bearing are two major bearing types for roller cone bits. Cones can be machined with steel teeth or mounted with carbide inserts as cutting elements. Drilling fluid enters water course of the bit from drilling string and is then jetted out from three nozzles which are mounted in nozzle sockets on the bit. After impinging on the bottom of the well, the drilling fluid flows back upwardly from sides of the nozzle socket. The jet from the nozzles is directed to impinge on the space at midway between two adjacent cones in the vicinity of borehole wall. Three points on heel row inserts of the cone contact the borehole wall at a leading side of the cone.

Following problems occur when the existing bit is used on turbo drills or high speed down hole motors for high RPM drilling applications. (1) The bearing life is greatly decreased because a journal bearing cannot withstand high RPM and a roller bearing cannot withstand high WOB. (2) High RPM drilling is generally accompanied by high WOB. This would considerably increase the impact force acting on cutting elements of the bit, and thus the lateral and longitudinal vibrations of the bit become more serious. As a result, cutting elements of the bit wear fast and can be easily broken, consequently reducing the drilling efficiency. Besides, when high RPM bit is used to drill hard formation, heat can be generated on cutting elements fast by wear and if timely cooling cannot be achieved, premature failure of the cutting elements would occur.

SUMMARY OF THE INVENTION

The disclosure herein provides a tri-cone bit for high RPM drilling applications in order to solve above mentioned problems associated with existing technology. The bit according to the present invention can withstand higher WOB under high RPM condition. Meanwhile, impact force on the cutting elements is reduced to increase the cutting efficiency, and thereby the overall drilling efficiency of the bit is improved.

The above objects are achieved by a tri-cone bit for high RPM drilling applications comprising three head sections and three cones each of which is attached at a lower end of the corresponding head section, wherein upper parts of the three head sections are joined together to form a bit body, on which nozzle sockets are provided, and nozzles are installed in bores of the nozzle sockets, being characterized in that a bearing between the cones and the head sections is a composite roller-journal bearing which is formed by rollers and arc-shaped slides arranged in an alternating way, and a seal means for the bearing is of metal face type.

Preferably, a diameter of external arc surface of the slides of the roller-journal bearing is the same as an inside diameter of the bores of the cones, a length of the slides is the same as that of the rollers. A radial thickness of the slide is larger than a diameter of the roller by 0.03 to 2.00 mm. The above range is not limited to this, but dependent on the diameter of the bit. The diameter of the bit is from 75 mm to 660 mm. An arc length of a pitch circle of the slides, on which circle the contact points between the slide and roller are provided, is smaller than or equal to two times of the diameter of the rollers.

Preferably, there is a sliding bushing between the roller-journal bearing and a shaft of the head section and the sliding bushing is made of tool steel.

Preferably, flanks at both sides of the slide are parallel with each other the slides are made of tool steel or spring steel and the rollers are made of bearing steel.

Preferably, an oil seeping portion is provided at one end or both ends of an external arc surface of the slide. Alternatively, the oil seeping portion is provided at one end or both ends of an internal arc surface of the slide.

Preferably, a rear side of upper part of the head OD (outer diameter) extends backwardly a distance to form an extended block whose rotational diameter is slightly smaller than gage diameter of the bit by 0.3 to 1.5 mm, and two to three rows of gage inserts are provided on the extended block with two to three gage cutters in each row, so as to form a gage protection surface on the upper part of the head section. The gage cutters in each row are arranged in a staggered way, and thus six gage protection points are formed with the cones, i.e. one gage protection point on each of the three cones and one on OD of each of the three head sections. Said gage cutters are carbide inserts or diamond enhanced carbide inserts.

Preferably, oil grooves are provided at both internal and external arc surfaces of the slide, an angle of 0 to 75° is formed between an axial end face of the slide and the oil grooves, and the oil grooves are parallel with each other. More preferably, the oil grooves on internal and external arc surfaces are positioned and oriented to form an interlaced pattern.

Preferably, said seal means is of double metal face type and comprises a first rubber seal and a first metal face seal, both mounted on a shaft of the head section, and a second rubber seal and a second metal face seal, both mounted in the bore of the cone. In this way, the end faces of the first and second metal face seals cooperate to form a rotational dynamic seal.

Preferably, cutting elements arranged on the cones include primary cutting elements and heel row cutting elements. Primary cutting elements are convex crested inserts including convex crested wedge inserts (see CN200510019419.2), and heel row cutting elements are wedge inserts or spherical inserts.

Preferably, nozzle socket is provided in the extended block at a rear side of the upper part of the head OD, and the nozzle directs fluid jet toward a leading side of the following cone.

Preferably, a leading side of the head section is entirely deflected backward with an angle of 10° to 30°, so as to form a spiral backflow channel with a rear side of the leading head section through which drilling fluid flows upwardly after impinging on the bottom of the well.

The following technical benefits can be achieved through the bit according to the invention. (1) As the composite roller-journal bearing can withstand high RPM and higher load and also has a better resistance to impact, a longer bearing life is ensured for the roller cone bit under high RPM and medium high WOB conditions. The bearing life is further extended by utilizing metal face seal means that is suitable for application with high rotary speed and high temperature. (2) The sliding movement and lubrication of the arc-shaped slide are improved by arranging a sliding bushing between the roller-journal bearing and a shaft of the head section as well as providing oil grooves on the arc-shaped slide, and this can further improve rotary speed of the bit under medium high WOB condition. (3) By providing the oil seeping portion at one end or both ends of external arc surface of the slide, the lubricant between the oil seeping portion and the cone can then be spread to a contact region between the cone and the external arc surface of the slide as a result of relative movement between the slide and the cone. Therefore, the lubrication of the contact region is improved, thereby allowing a further increase of RPM of the bit under medium high WOB condition. (4) By providing the oil seeping portion at one end or both ends of internal arc surface of the slide, the lubricant between the oil seeping portion and the sliding bushing can then be spread to a contact region between the sliding bushing and the internal arc surface of the slide as a result of relative movement between the slide and the sliding bushing. Therefore, the lubrication of the contact region is improved, thereby allowing a further increase of RPM of the bit under medium high WOB condition. (5) As convex crested inserts are more aggressive and can drill formation rock more easily, drilling efficiency and effective working life of the bit under high RPM condition are both improved. In addition, the above 6-point gage protection structure makes the bit more steady during drilling, thus reducing the breakage of the cutting elements caused by bit vibration. So, the working life of the cutting elements on bit is further extended. (6) The spiral backflow channel facilitates upward removal of drilling cuttings from the bottom of the well, and the directed jet enhances cooling of the cutting elements, thus further improving drilling efficiency.

The tri-cone bit of the invention is particular advantageous in drilling applications under high RPM and medium high WOB conditions for the features including composite roller-journal bearing, metal face seal, special gage protection surface formed by enlarging diameter at rear side of upper part of head OD, as well as specially designed cutting structure and hydraulic system. The bit according to the present invention can operate excellently during drilling applications with greatly higher drilling efficiency and longer working life. Footage and working life of the bit under WOB of 80 to 140 KN and RPM of 400 r/min are both more than two times those of the existing roller cone bit.

BRIEF DESCRIPTION OF THE DRAWINGS

For a more detailed description of the preferred embodiments, reference will now be made to the accompanying drawings, wherein.

DETAILED DESCRIPTION OF PREFERRED EMBODIMENT

Figure 1:
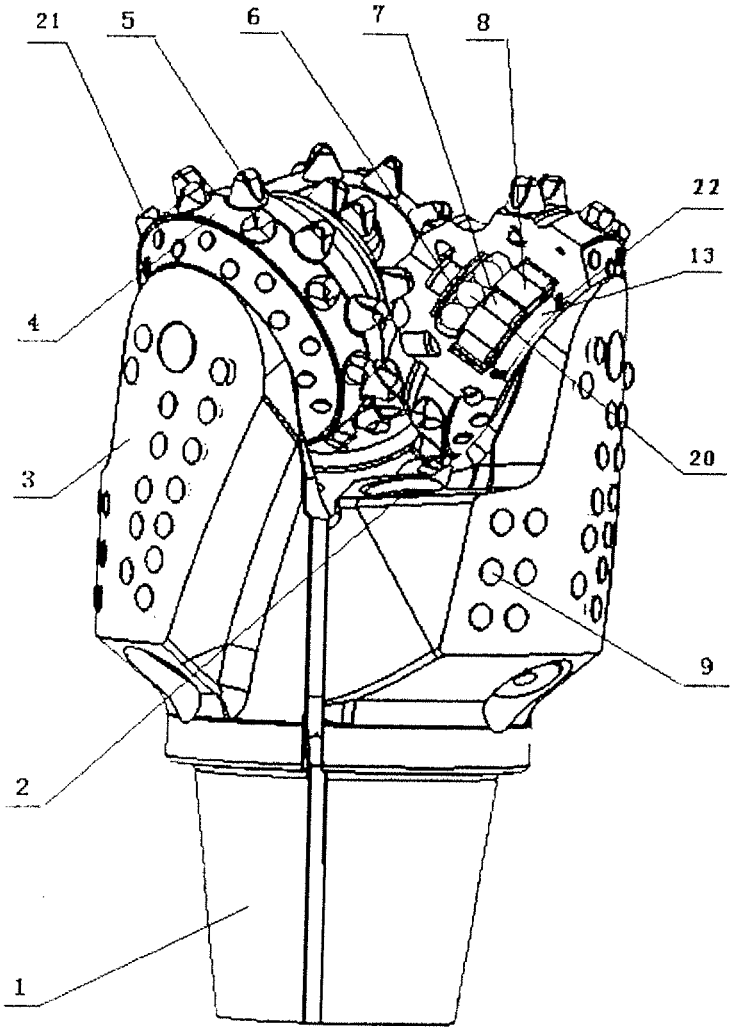
FIG. 1 is a front view of a bit according to an embodiment of present invention.
Figure 2:
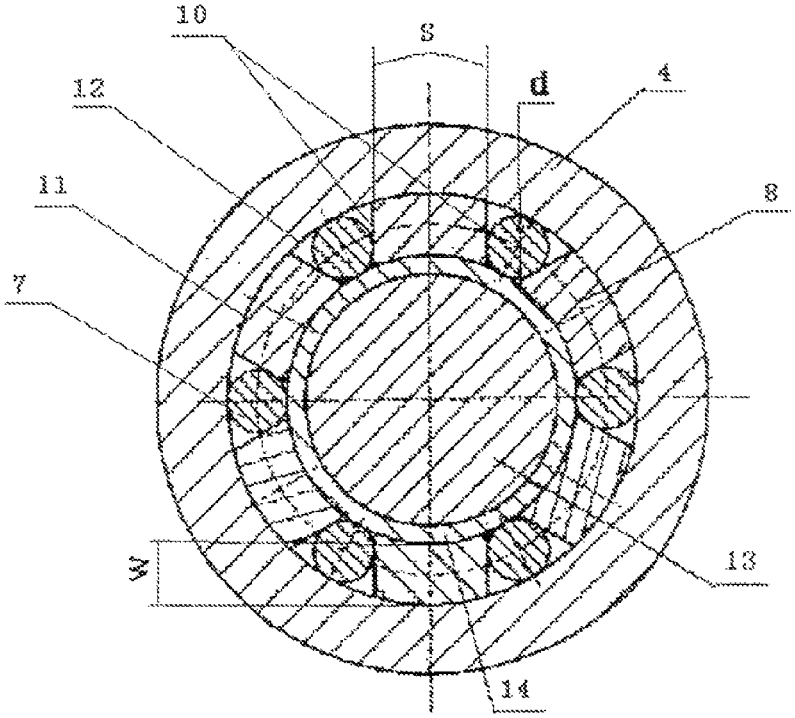
FIG. 2 is a cross-section view of the bearing in the bit according to the embodiment of present invention.
Figure 3:
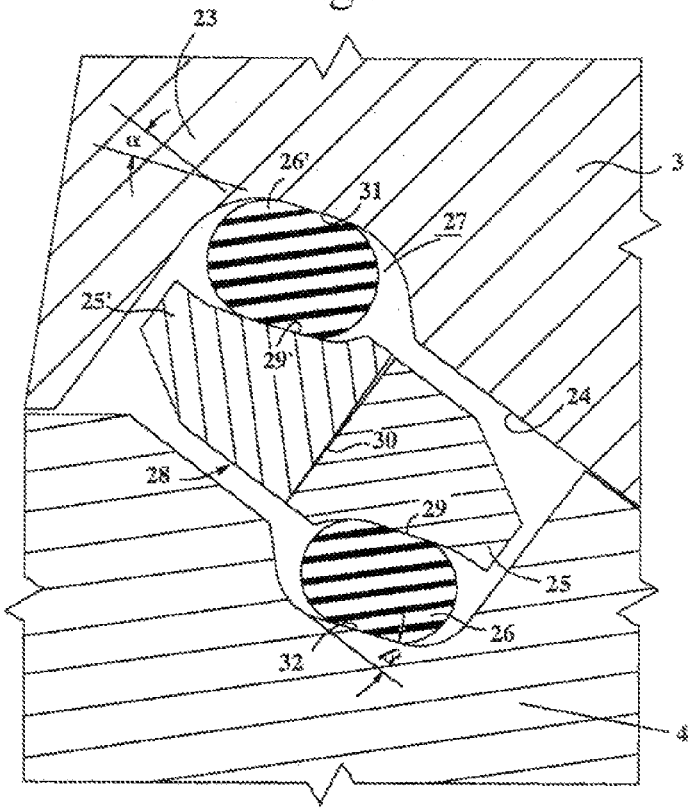
FIG. 3 is a partial enlarged cross-section view of the metal face seal in the bit according to the embodiment of present invention.
Figure 4:
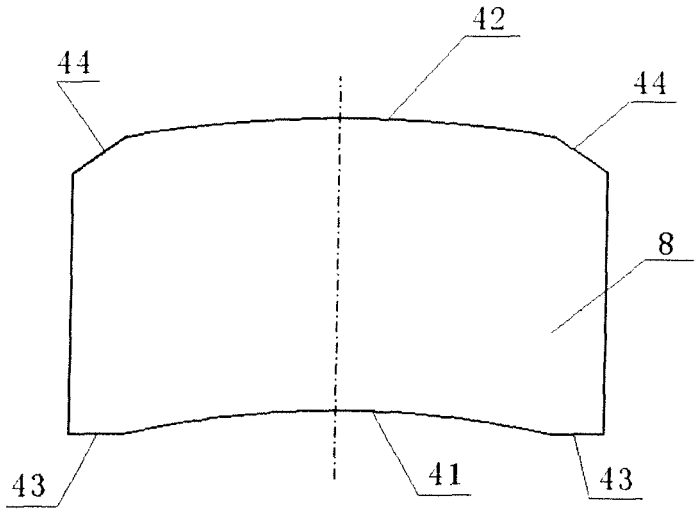
FIG. 4 is an end view of an arc-shaped slide in the bit according to the embodiment of present invention.
Figure 5:
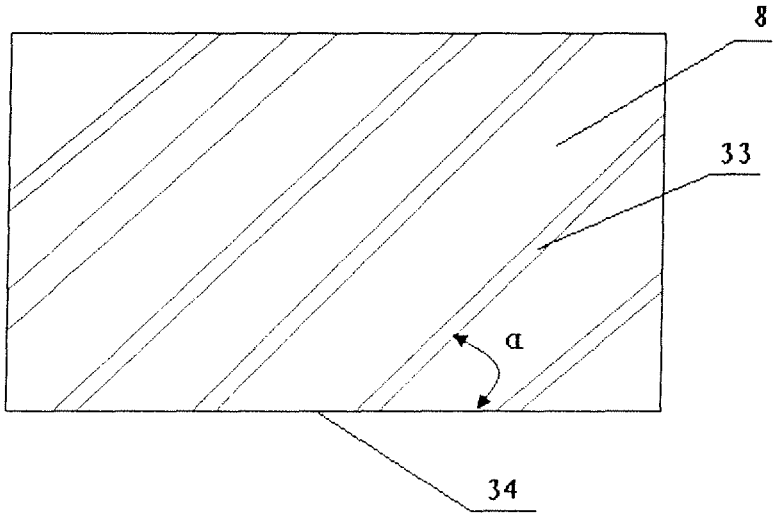
FIG. 5 is a partial top view of the arc-shaped slide in the bit according to the embodiment of present invention.
Figure 6:
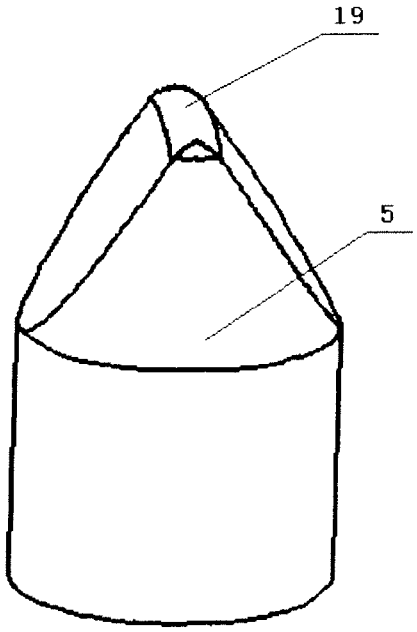
FIG. 6 is a schematic view showing the shape of the insert in the bit according to the embodiment of present invention.
Figure 7:
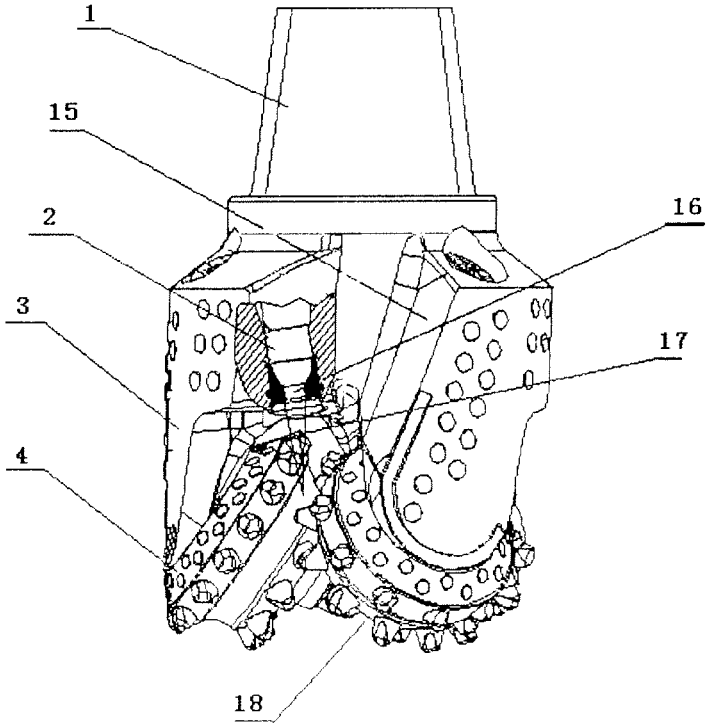
FIG. 7 is a front view of the bit according to the present invention in operation (oriented downwardly).

Referring to FIGS. 1 to 7, a tri-cone bit according to a preferred embodiment of the present invention is disclosed.

The tri-cone bit according to the embodiment comprises three head sections 3 and three cones 4 mounted on lower ends of the corresponding head sections respectively. Upper parts of the head sections 3 are welded together to form a bit body. Tapered threads 1 are machined on upper part of the bit body to be engaged with drill string. The cones are retained on shafts of the corresponding head sections respectively by means of steel balls 20. The bearing 6 between the cone and the shaft of the head section is a composite roller-journal bearing formed by rollers 7 and arc-shaped slides 8 arranged in an alternating way.

Two flanks 10 at both sides of the arc-shaped slide 8 are parallel with each other and are symmetrical about a center line of the slide 8. The diameter of the outer arc 11 of the slide 8 is the same as the inside diameter of the hole 12 of the cone. The radial thickness W of the slide 8 is larger than the diameter d of the roller 7 by 0.08 to 0.20 mm. The length of the slide 8 is the same as that of the roller 7. The ratio between the arc length S of the pitch circle of the slide 8 and the diameter d of the roller 7 is 1.5. The slides 8 are made of tool steel, and the rollers 7 are made of bearing steel. An oil seeping portion 44 is provided at both ends of external surface 42 of the arc shaped slide 8. An oil seeping portion 43 is provided at both ends of internal surface 41 of the arc shaped slide 8. Oil grooves 33 are provided at both internal and external arc surfaces of the slide 8, and an angle $\alpha$, for example 45°, is formed between axial end face 34 of the slide 8 and the oil groove 33. The oil grooves on internal and external arc surfaces of the slide 8, being opposite with each other, are arranged in a interlaced pattern. A sliding bushing 14, made of tool steel for example, is also arranged in-between slide 8, roller 7 and shaft 14 of the head section. The sliding bushing 14 has a single side radial thickness of 2 to 4 mm.

The seal means 22 for the bearing between the cone and the shaft of the head section is of double metal face seal type. The seal means 22 is formed by a pair of metal rings 25 and 25', a pair of rubber rings 26 and 26', a sealing groove 27 at root 23 of the head section 3 and a sealing groove 28 at mouth of the cone 4. The end faces of the metal rings 25 and 25' are in tight contact to form an axial end face sealing which is a rotational dynamic sealing. Compared with common O-ring seals of rubber, such an end face sealing can withstand higher relative rotary speed between the cone and the shaft of the head section and higher temperature. The rubber rings 26 and 26' are O-rings. The contact surface between the rubber ring 26' and the sealing groove 27 of the head section 3 is labeled as 31, and the contact surface between the rubber ring 26' and metal ring 25' is labeled as 29'. An angle $\alpha$ is defined by the contact surfaces 31 and 29' with center line of the head bearing. The contact surface between the rubber ring 26 and sealing groove 28 of the cone 4 is labeled as 32, and the contact surface between the rubber ring 26 and the metal ring 25 is labeled as 29. An angle $\beta$ is defined by the contact surfaces 32 and 29 with center line of the head bearing. The rubber rings 26 and 26' serve to ensure tight contact between the two metal rings 25 and 25', and they also function as a static seal.

Primary cutting elements 5 and heel row cutting elements 21 are provided on said cones 4. Primary cutting elements 5 are convex crested inserts whose crest is formed by a convex curve surface. Heel row cutting elements 21 are wedge inserts or spherical inserts. A leading side 15 of the head section is integrally deflected backward with an angle of 20° to 30° so as to form a spiral backflow channel with a rear side of the leading head section. The drilling fluid flows upwardly through the backflow channel after impinging on the bottom of the well. A rear side of upper part of the head OD extends backwardly a certain distance to form an extended block whose rotational diameter is slightly smaller than gage diameter of the bit by 1.0 to 1.5 mm. Two to three rows of gage inserts are provided on the extended block with two to three gage inserts 9 in each row, so as to form a gage protection surface on the upper part of the head section. The gage inserts 9 in adjacent rows are arranged in an alternating way. The rotational radius where the gage inserts are located is smaller than the radius of the bit by 0.5 mm, and reduces gradually upwards and rearwards. In this way, three gage protection points are formed on head OD. In addition, two to three rows of gage protection inserts are arranged on the head section with 4 to 8 inserts in each row. Nozzle socket 2 is provided in the extended block at the rear side of upper part of the head OD, and nozzle 16 is installed in the bore of the nozzle socket 2. Jet flow 17 from the nozzle 16 is directed to a leading side 18 of the following cone.

While some embodiments of the invention have been described above, for the illustrative purpose only, it is to be understood that the invention is not limited to the details of the illustrated embodiments, but may be embodied with various changes, modifications or improvements, which may occur to those skilled in the art without departing from the spirit and scope of the invention.

What is claimed is:

1. A tri-cone bit for high RPM drilling applications comprising three head sections and three cones each of which is attached at a lower end of the corresponding head section, wherein upper parts of the three head sections are joined together to form a bit body, on which nozzle sockets are provided, and nozzles are installed in bores of the nozzle sockets, being characterized in that a bearing between the cones and the head sections is a composite roller-journal bearing which is formed by rollers and arc-shaped slides arranged in an alternating way, and a seal means for the bearing is of metal face type, wherein a radial thickness of the slides is larger than a diameter of the rollers by 0.03 to 2.00 mm;

wherein oil grooves are provided at both internal and external arc surfaces of the slide, said oil grooves extend from one circumferential end side of the slide to the other circumferential end side of the slide, and the oil grooves at the internal arc surface of the slide are parallel with each other, and the oil grooves at the external arc surface of the slide are parallel with each other, and wherein the oil grooves on internal arc surface of the slide are positioned and oriented to form an interlaced pattern with the oil grooves on the external arc surface of the slide;

wherein cutting elements arranged on the cones include primary cutting elements, which are convex crested inserts whose crest is formed by a convex curve surface, and heel row cutting elements, which are wedge or spherical inserts.

2. The tri-cone bit of claim 1 wherein a diameter of external arc surfaces of the slides of the roller journal bearing is the same as an inside diameter of the bores of the cones, a length of the slides is the same as that of the rollers, an arc length of a pitch circle of the slides is smaller than or equal to two times of the diameter of the rollers.

3. The tri-cone bit of claim 1 or 2 wherein there is a sliding bushing between the roller journal bearing and a shaft of the head section, and the sliding bushing is made of tool steel.

4. The tri-cone bit of claim 1 or 2 wherein flanks at both sides of the slides are parallel with each other, the slides are made of tool steel or spring steel and the rollers are made of bearing steel.

5. The tri-cone bit of claim 4 wherein an oil seeping portion is provided at one end or both ends of an external arc surface of the slide.

6. The tri-cone bit of claim 4 wherein an oil seeping portion is provided at one end or both ends of an internal arc surface of the slide.

7. The tri-cone bit of claim 1 or 2 wherein a rear side of upper part of the head OD extends backwardly a distance to form an extended block whose rotational diameter is slightly smaller than gage diameter of the bit by 0.3 to 1.5 mm, and two to three rows of gage inserts are provided on the extended block with two to three gage cutters in each row, so as to form a gage protection surface on the upper part of the head section.

8. The tri-cone bit of claim 7 wherein nozzle socket is provided in the extended block at a rear side of the upper part of the head OD, and the nozzle directs fluid jet toward a leading side of the following cone.

9. The tri-cone bit of claim 7 wherein a leading side of the head section is entirely deflected backward with an angle of 10° to 30°, so as to form a spiral backflow channel with a rear side of the leading head section through which drilling fluid flows upwardly after impinging on the bottom of the well.

10. The tri-cone bit of claim 1 or 2 wherein an angle of 0 to 75° is formed between an axial end face of the slide and the oil grooves.

11. The tri-cone bit of claim 1 or 2 wherein said seal means is of double metal face type and comprises a first rubber seal and a first metal face seal, both mounted on a shaft of the head section, and a second rubber seal and a second metal face seal, both mounted in the bore of the cone, and wherein end faces of the first and second metal face seals cooperate to form a rotational dynamic seal.

* * * * *